United States Patent [19]

Schwitzgebel

[11] 4,272,969

[45] Jun. 16, 1981

[54] METHOD FOR REFRIGERATING FRESH PRODUCTS AND KEEPING THEM FRESH, AS WELL AS REFRIGERATOR FOR CARRYING OUT THIS METHOD

[76] Inventor: Fernand Schwitzgebel, c/o Hermann Forster, CH 9320 Arbon, Switzerland

[21] Appl. No.: 874,941

[22] Filed: Feb. 3, 1978

[30] Foreign Application Priority Data

Feb. 3, 1977 [DE] Fed. Rep. of Germany ..... 2704562
Dec. 23, 1977 [DE] Fed. Rep. of Germany ..... 2757644

[51] Int. Cl.[3] ..... F25D 17/06; F24F 3/16; F25D 21/00; F25D 5/00

[52] U.S. Cl. ..... 62/419; 62/78; 62/91; 62/272; 62/314; 62/414

[58] Field of Search ..... 62/91, 274, 418, 419, 62/410, 411, 314, 454, 78, 272

[56] References Cited

U.S. PATENT DOCUMENTS

| | | | |
|---|---|---|---|
| 2,053,453 | 9/1936 | Wendler | 62/410 |
| 2,089,953 | 8/1937 | Gaugler | 62/78 |
| 2,315,285 | 3/1943 | Demnington | 62/78 X |
| 2,492,308 | 12/1949 | Menges | 62/91 |
| 2,912,834 | 11/1959 | Mann | 62/418 |
| 3,183,683 | 5/1965 | Reiter et al. | 62/411 |
| 3,186,186 | 6/1965 | Kleist | 62/419 |
| 3,638,449 | 2/1972 | Lichtenberger | 62/419 |
| 4,043,141 | 8/1977 | Levy et al. | 62/91 |
| 4,044,570 | 8/1977 | Ono et al. | 62/419 |
| 4,061,483 | 12/1977 | Burg | 62/91 |

*Primary Examiner*—Lloyd L. KIng
*Attorney, Agent, or Firm*—William R. Price

[57] ABSTRACT

A refrigerator for maintaining high humidity therein where the evaporator surfaces are oversized and maintained at a frost-free temperature, continuous forced air is passed over the evaporator and over a drip water dish within the refrigerator compartment, and the compartment is vented to the outside of the refrigerator.

13 Claims, 7 Drawing Figures

METHOD FOR REFRIGERATING FRESH PRODUCTS AND KEEPING THEM FRESH, AS WELL AS REFRIGERATOR FOR CARRYING OUT THIS METHOD

BACKGROUND OF THE INVENTION

1. Field of the Invention

The subject of the present invention is a method for refrigerating fresh food products and keeping them fresh, particularly fruits and vegetables, as well as wine and similar beverages, in a refrigerator which has a closable cold-insulated interior with an evaporator traversed by the refrigerant, which reduces the temperature of the air volume contained in the interior regularly relative to the outside temperature.

2. Description of the Prior Art

The traditional ideal storage space (e.g. cellar) is increasingly rarer to find. The requirements for a storage room are a possibly constant temperature, as well as a relative humidity of 90%. In most buildings, the storage rooms have too high temperatures as well as a too low relative humidity. These inadequate conditions have the result that foods, like fruits, vegetables and potatoes, as well as quality wines, can no longer be stored or only for a very short time.

Conventional refrigerators can not solve this problem either, since they have a relatively small evaporator (hence a small evaporator surface) whose surface temperature is kept below 0 deg.C. This is extremely harmful for the stored material to be refrigerated, since the evaporator surface freezes up immediately and, due to the progressing freezing process, more and more moisture given off by the goods to be refrigerated is transformed on the evaporator into ice, so that moisture is constently withdrawn from the surrounding of the goods to be refrigerated, and the goods to be refrigerated dry out and become unusable.

Perishable foods have mostly a high moisture content (70–90%) so that a relative humidity between 90 and 99% is normally formed on their surface in the equilibrium. This relative humidity must consequently be maintained in the storage space to prevent evaporation of water from unprotected surface. Conventional refrigerators could not prevent the constant withdrawal of moisture from the goods freely stored in the refrigerator, since the evaporator surfaces are always kept at a temperature below 0 deg.C. and the evaporator surfaces are relatively small. This combination of a relatively small evaporator surface with a relatively low surface temperature was selected heretofore to save space in the refrigerator and still provide the refrigerating capacity necessary for conditioning the goods available.

SUMMARY OF THE INVENTION

The present invention is based on the above mentioned arrangement and its object is to prevent the drying of perishable goods stored in the refrigerator, these goods consisting preferably of fruits (including tropical fruits), vegetables, bottled wine and similar beverages.

According to the present invention, a method is described which consists substantially in that the air contained in the refrigerator and flowing from around the goods to be refrigerated is conditioned in the manner according to the invention. The essential principle of the invention is the combination of three features which lead to the conditioning of the air contained in the interior of the refrigerator according to the definition.

According to present invention, the evaporator is arranged in the air flow of a continuous fan and the evaporator surface has a temperature of above 0 deg.C., while the relative humidity is maintained in a range of 80 to 98%. The air contained in the refrigerator is kept free of ripening-enhancing metabolic gases.

The essential feature of the present method is thus that the air volume contained in the refrigerator is conditioned in such a way that the air volume is drawn in by a continuous fan and conducted over the surface of an evaporator which is kept free of ice according to the invention, while at the same time the air contained in the refrigerator is in constant gas exchange with the surrounding air outside the refrigerator, so that the air contained in the refrigerator is kept free of ripening-enhancing metabolic gases ($CO_2$, ethylene, odorous substances).

The combination of these three features has the advantages according to the definition, namely that a constant air circulation is ensured by the air current produced by the continuous fan, and that the formation of temperature-and humidity gradients is prevented in the proximity of the evaporator and of the goods to be refrigerated. The provision that the temperature of the evaporator surface must be above 0 deg. C. ensures that the evaporator surfaces can not freeze up. This way the essential advantage over the state of the air is achieved, namely that no humidity can be withdrawn anymore from air surrounding the goods to be refrigerated due to the non-icing condition, so that drying of the goods is prevented. But it is also conceivable that in relatively small refrigerators (hence with a low refrigerating volume), only the evaporator surface must be kept free of ice, without having to use a fan, or that a constant gas exchange must then be ensured with the surrounding air.

Keeping the air contained in the refrigerator free of ripening-enhancing metabolic gases is ensured by the fact that vent holes are provided in the inner wall of the refrigerator which ensure a constant gas exchange with the outer air surrounding the refrigerator. Due to the additional circulation of the air contained in the refrigerator caused by the continuous fan, the gas exchange through the vent holes is accelerated, which further ensures that the air contained in the interior of the refrigerator is kept free of ripening-enhancing metabolic gases. The vent holes are preferably made so small that the loss of cold can be replaced by the evaporator.

For carrying out the method according to the inventon, a refrigerator is described which is characterized in that an additional throttle element is arranged in the return line between the compressor and the evaporator. With this additional throttle element it is possible to keep the temperature of the evaporator above 0 deg. C., while maintaining the other operating conditions of the compressor. This in turn yields the required high humidity and, together with the correspondingly adjusted temperature between 0 and 10 deg.C., the optimum climate for the long-term storage of fruits and vegetables.

The additional throttle element can be, for example, a suction-pressure-regulating valve which is relatively expensive, however. Preferred is therefore the design of this additional throttle element as a capillary pipe. With this additional throttle element, the line of the conventional compressor is throttled to such an extent that the temperature of the evaporator is kept above 0 deg.C. At the same time this ensures that the compressor works in its optimum operating range.

It is important according to the present invention that the air current of the continuous fan passes over the evaporator and impinges on the drip water dish filled with condensed water, and that one or more vent holes are provided in the casing of the refrigerator for gas exchange of the air contained in the refrigerator with the surrounding air. The combination of the three above-mentioned features leads to the solution of the problem according to the invention. The first mentioned feature that the air current of the continuous fan passes over the evaporator has the advantage that the amount of cold produced by the evaporator is eliminated rapidly from the evaporator surface, so that icing of the evaporator surface is positively prevented. This feature has the further advantage that the temperature of the evaporator surface can also be slightly below 0 deg.C., (e.g. down to about −4 deg.C.), since the warmer air drawn in by the fan raises the temperature of the evaporator surface in the minus range to such an extent that icing is avoided evan at an evaporator temperature in the minus range.

The feature that the air current of the fan impinges on a drip water dish filled with condensed water has the essential advantage that there is a constant moisture reservoir in the interior of the refrigerator and that air current impinging on the surface of the water level constantly absorbs moisture and returns it into the air surrounding the goods to be refrigerated. This ensures that the humidity gradient in the air surrounding of the goods to be refrigerated is further reduced, because air saturated with steam is returned to the air surrounding the goods to be refrigerated.

The third feature, that one or more vent holes are provided in the casing of the refrigerator for gas exchange of the air contained in the refrigerator with the surrounding air has the advantage that ripening-enhancing metabolic gases, which otherwise lead to rapid ripening of the goods to be refrigerated, are rapidly eliminated from the air surrounding the goods to be refrigerated by means of the air current produced by the fan and are discharged through the vent holes in the refrigerator into the outer air surrounding the refrigerator.

All three of the above mentioned features together lead to the desired result according to the invention, but it is understood that the features can also be used separately.

It was also pointed out in the introduction that the problem of the invention could not be solved with conventional refrigerators, since relatively small evaporators are used (that operates, with a small surface), whose surface is in the negative Celsius temperature range. This way it was possible with conventional refrigerators to achieve a relatively high refrigerating capacity with a relatively small space requirement of the evaporators.

In order to be able to achieve similarly high refrigerating capacity, the evaporator used in the present refrigerator is far bigger than conventional evaporators. Preferably the surface of the evaporator is twice the size of conventional evaporators. In practice, however, it is also possible to provide the evaporator with a 10-times larger surface than comparable evaporators in conventional refrigerators with a comparable refrigerating volume.

BRIEF DESCRIPTION OF THE DRAWINGS

The invention will now be described more fully on the basis of an embodiment. This description shows additional advantages and features of the present invention.

The protection, however, is not to be limited to this possible realization of the inventive idea; besides, the reference numbers are only of illustrative nature.

DESCRIPTION OF THE PREFERRED EMBODIMENTS

Figure 1:
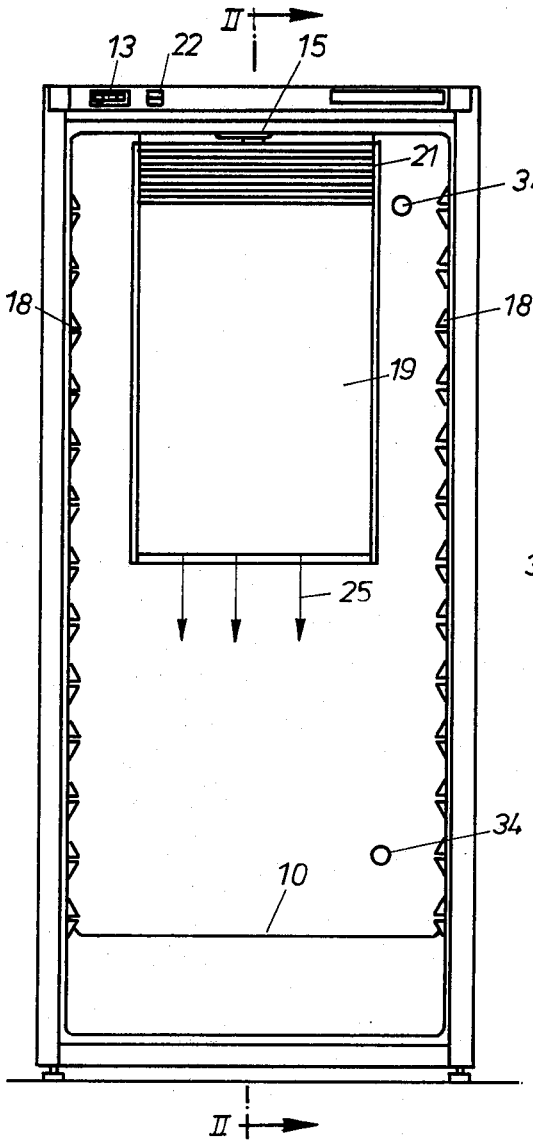
FIG. 1 shows a refrigerator according to the present invention in a front view with the door open, where slide-in baskets for storing the goods to be refrigerated have been removed.
Figure 2:
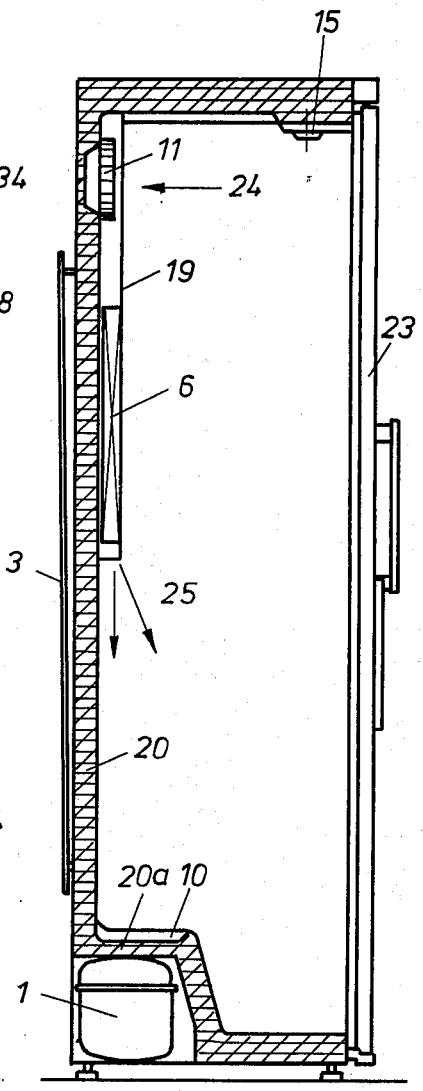
FIG. 2 shows the refrigerator according to FIG. 1 in a cross-sectional elevational view along line II—II in FIG. 1.
Figure 4:
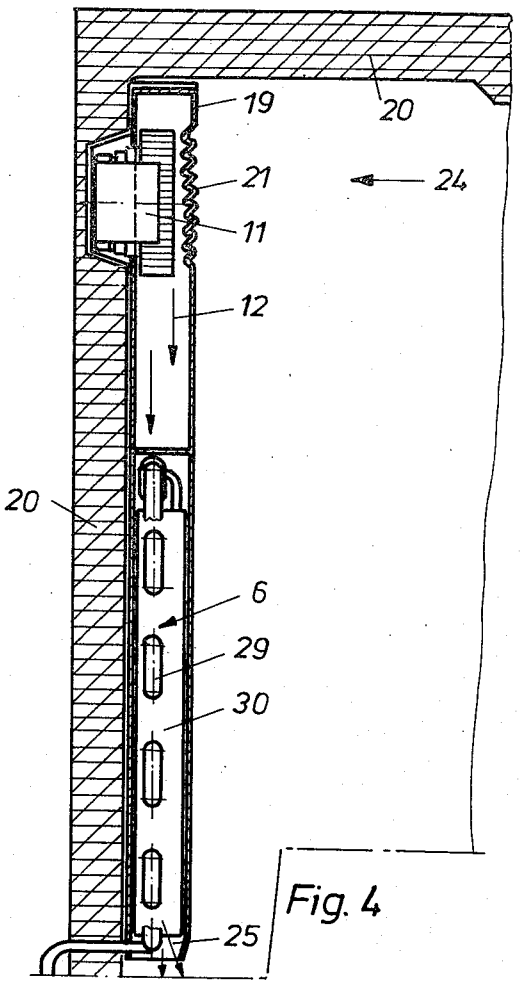
FIG. 4 shows a section along line IV—IV of FIG. 3.

The refrigerator shown in FIG. 1 consists of a casing and a door (not shown) which seals the front side of the refrigerator. On the side walls of the refrigerator are provided on the inside slide-rails 18 which serve to receive wire baskets or similar containers in which the goods to be refrigerated are kept. In FIGS. 2 and 4 the slide rails 18 are no longer shown for clarity's sake.

On the outside, at the top of the refrigerator is provided a tele-thermometer 13, as well as a switch 22. On the inside at the top is arranged a thermostat 15 which serves to set the desired inside temperature by means of an adjusting wheel.

Figure 3:
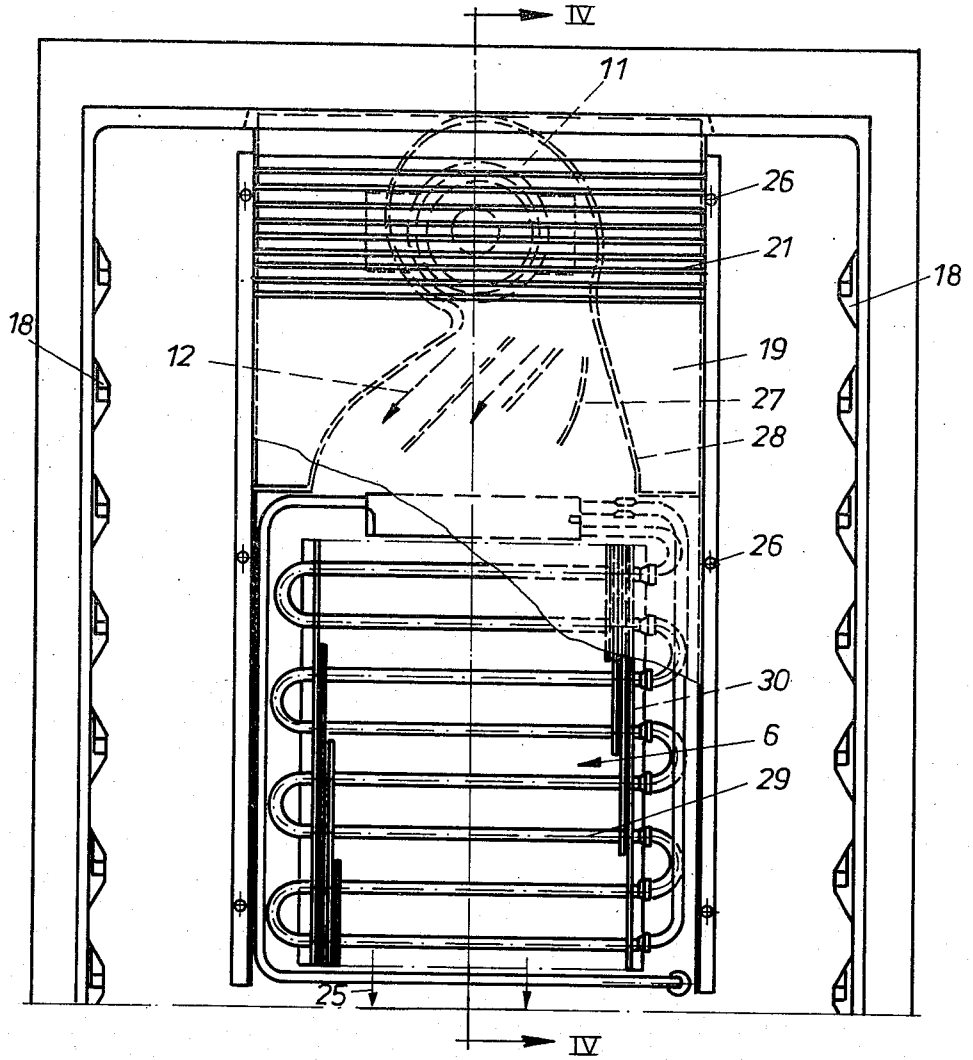
FIG. 3 shows on an enlarged scale a fragmentary detailed view of the evaporator with the cover in the interior of the refrigerator with the underlying units in a partial section.

On the inner rear side of the refrigerator is provided a cover 19 which is shown on an enlarged scale in FIGS. 3 and 4. Cover 19 is secured according to FIG. 3 with screws 26 on the inner rear side of the refrigerator and consists of a pre-curved plastic plate with suction slits 21 provided therein, through which fan 11 secured behind the cover on the refrigerator draws in the air in a horizontal plane and then distributes the air down over evaporator 6 secured under the fan and likewise arranged on the inner rear side of the refrigerator.

As it can be seen particularly from FIG. 4, fan 11 is preferably designed as a radial flow fan, since the space requirement can be kept at a minimum with such a design. at a minimum. It is also preferred if evaporator 6 is designed as a lamination type evaporator. This has the essential advantage that an evaporator with a high refrigerating capacity can be provided in a relatively small space. Evaporator 6, designed as a lamination-type evaporator, consists according to FIGS. 3 and 4 of evaporator coils 29, which are in physical contact with laminations 30 arranged perpendicularly thereto. The air current of fan 11 flowing tangentially in direction 12 over laminations 30 leads the cold produced by evaporator 6 away from the latter and pushes the air thus cooled on the underside of the cover in the direction of arrow 25 into the interior of the refrigerator. Another essential feature of the present invention is that the air current of fan 11 passes over evaporator 6 and impinges on the drip water dish 10 filled with condensed water. The fan 11 draws the air from the interior of the refrigerator through slits 21 of cover 19, then the air passes over evaporator surface 29, 30 and discharges in a vertical plane (direction of arrow 25) out of cover 19. The horizontal suction and vertical expulsion causes a circulation of the air in the interior of the refrigerator, so that the air passes constantly over the goods to be refrigerated without air pockets with stagnant air being formed in the interior of the refrigerator. At the same time this circulating air current ensures that the air is constantly replenished in the vicinity of the goods to be refrigerated, and that this air led off from the goods is partly conducted to the outside through vent holes 34 provided in the refrigerator.

Another essential feature of the invention is that the circulated air current impinges constantly on drip water dish 10 filled with condensed water. In the conventional refrigerators it was known to collect the condensed water in a drip water dish, but it was always intended in the conventional refrigerators to remove the collected drip water as soon as possible and completely from the interior of the refrigerator to the outside. This resulted in a constant withdrawal of moisture and loss of condensed water from the interior of the refrigerator dried out very rapidly. This is avoided according to the present invention in this way that the condensed water is collected in the drip water dish and discharge of the condensed water to the outside is substantially avoided. Due to the air current passing constantly over the drip water dish filled with condensed water, a constant evaporation of the condensed water in the drip water dish is thus achieved, and this condensed evaporated water is returned to the vicinity of the goods to be refrigerated by the continuous rotating air current.

Figure 5:
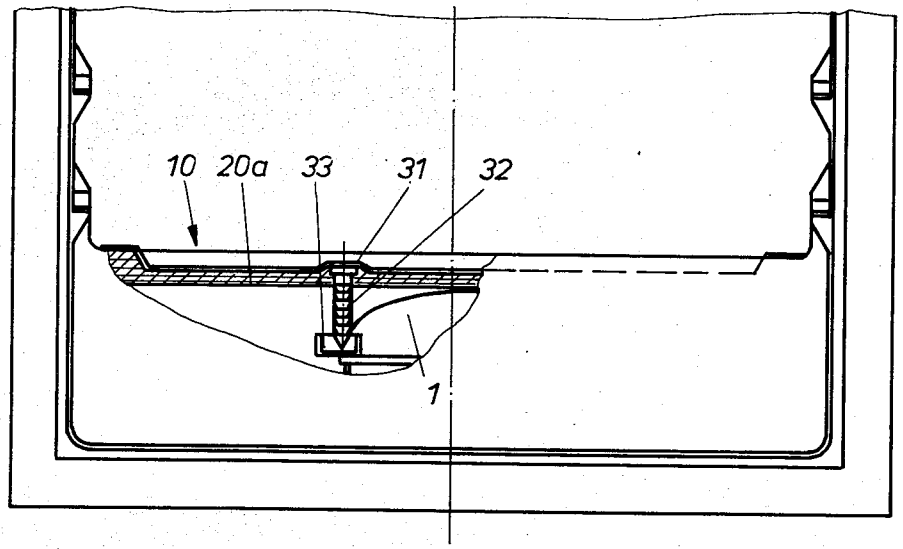
FIG. 5 shows in a partial section a detailed view of the drip water dish in a front view.

When the door of the refrigerator is opened, however, warmer air and more humid air enters the interior of the refrigerator. This air is dehumidified in evaporator 6, and it is possible that condensed water is formed. Due to the opening of the door and the entrance of humid, warm air, humid air is thus supplied to the interior of the refrigerator, and the condensed water can be collected in drip water dish 10. In order to avoid overflowing in drip water dish 10, the latter is provided with an overflow drain 31 rising above the bottom of the dish. The drain with a hose 32 serves to drain off excess condensed water from the interior of the refrigerator (see FIGS. 5 and 6). This ensures that there is always a water level of maximum height in drip water dish 10, while any surplus amount of water is always discharged to the outside. It is preferred if hose 32 opens into a collecting trough 33 which is secured to bear at least partly on the outer circumference of compressor 1. This feature ensures that the excess condensed water getting into collecting trough 33 rapidly evaporates from the collecting trough into the air surrounding the refrigerator, since collecting trough 33 is secured on the outer circumference of compressor 1, which is heated in the operating state.

Figure 6:
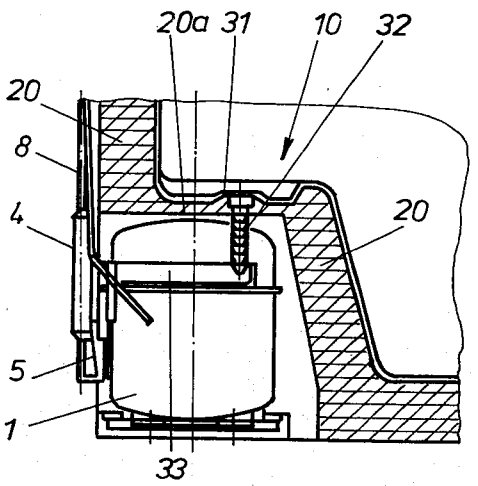
FIG. 6 shows a detailed view of the drip water dish in a cross section.

In order to further increase the humidifying capacity of drip-water dish 10, it is preferred that insulation **20*a* of the refrigerator is thinner in the vicinity of drip water dish 10 than the rest of insulation 20 of the refrigerator, and that drip water dish 10 is arranged above compressor 1 (see FIG. 6). This has the essential advantage that, due to the thinner insulation 20*a* of compressor 1 arranged under drip water dish 10, the latter can heat from the bottom, so that the condensed water contained in drip water dish 10 can be more heated, and the air current of fan 11 flowing over drip water dish 10** can absorb more humidity.

Figure 7:
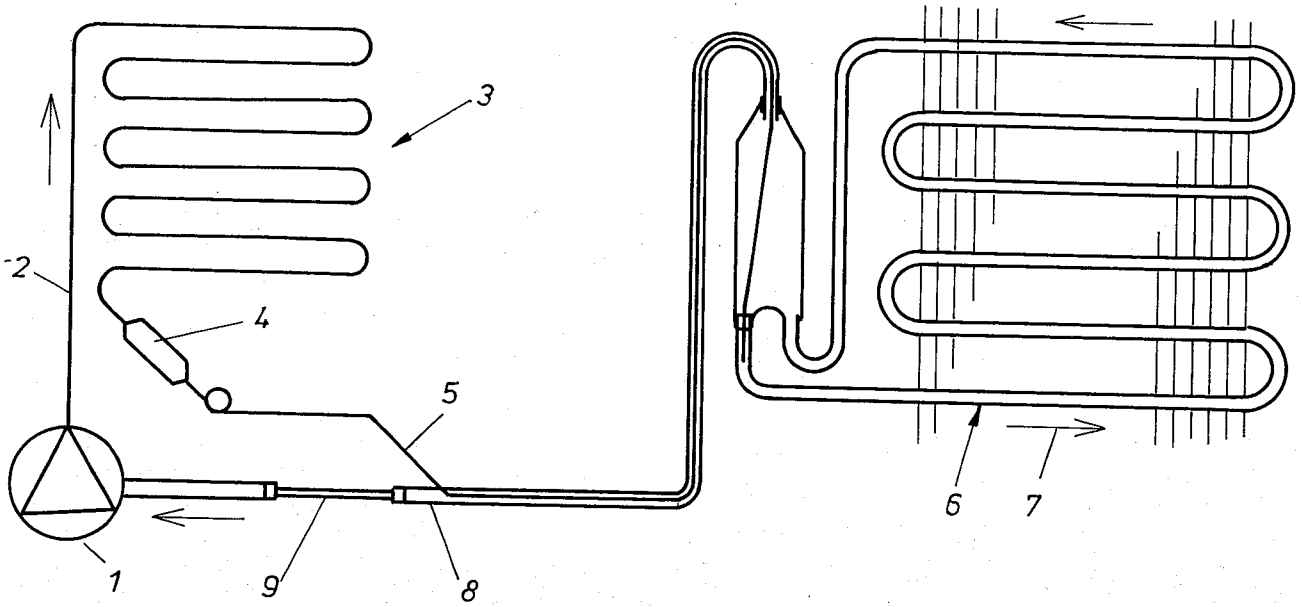
FIG. 7 shows schematically the essential structural elements of a refrigerating system for a refrigerator according to the invention.

The refrigerating system shown in FIG. 7 contains a compressor 1, which is connected by a line 2 with a air-cooled condenser 3 arranged outside of the refrigerator. From there the liquid refrigerant flows over a filter-drier 4, and from there over a throttle 5 designed as a high-pressure capillary pipe into an evaporator 6, which is arranged inside the refrigerator. The evaporator is traversed by the refrigerant in the direction of arrow 7 and returns over a line 8 back to compressor 1. The above described arrangement is customary in compression type refrigerating units. According to the invention, a low-pressure capillary 9 is arranged in line 8 between evaporator and compressor 1, which serves the above-mentioned purpose.

The air current flowing over the goods to be refrigerated with a temperature of above 0 deg.C., while at the same time a relatively high humidity is maintained and a constant gas exchange with the surrounding air is ensured, makes it possible with the system suggested here to store fruits and vegetables without any loss of quality over a period of several months with a maximum moisture loss of about 3% of the entire moisture content. Goods that can be stored are all known fruits and vegetables, including potatoes and tropical fruits. It is also possible to store jams, fruit juices, table water, red wine, white wine and ready to drink beverates without any loss of quality.

The present invention is not limited to the use of a refrigerating system according to the compression principle. It is also possible to arrange evaporator 6 in the refrigerant circuit of a system working on the absorption principle. Another embodiment of the present invention provides that the evaporator is replaced by Peltier refrigerating elements.

The invention is not limited to the form represented and described here; it also permits modification of individual parts and omission of certain features.

I claim:

1. A high humidity refrigerator for preventing the withdrawal of moisture from food products therein, said refrigerator including (a) a cold insulated compartment (b) a compressor, condenser and evaporator connected by refrigerant lines (c) said evaporator being positioned within, and in the upper portion of, said cold insulated compartment, and having a surface temperature above 0° C.

(d) a continuously operating fan located within said cold insulated compartment above said evaporator for directing air vertically downwardly past the evaporator to prevent icing of the evaporator surface, resulting in the formation of condensation thereon, and (e) a drip dish in the lower portion of the compartment beneath the evaporator for receiving water produced by the condensation dropping from the evaporator (f) said drip dish lying in the direct path of the air flow from the fan, whereby the air impinges upon the water contained in the drip dish to constantly absorb moisture therefrom and return it into the air surrounding the goods being refrigerated.

2. The refrigerator of claim 1, wherein
(a) said drip dish is provided with an overflow drain which extends above the bottom of the dish to drain off excess water from the drip dish.

3. The refrigerator of claim 2, with the addition of
(a) a collecting trough exteriorly of said compartment, and in communication with said overflow drain, for receiving the excess water.

4. The refrigerator of claim 1, with the addition of
(a) at least one vent opening in said compartment for exchanging air from within the compartment to the outside.

5. The refrigerator of claim 1, wherein
(a) said continuously operated fan is a radial flow fan.

6. The refrigerator of claim 1, wherein
(a) said evaporator is of the lamination type
(b) said evaporator including evaporator coils
(c) laminations perpendicular to, and in contact with, said evaporator coils, whereby the air flowing over said laminations, draws the cold away from the evaporator and into the interior of the compartment.

7. A high humidity refrigerator for preventing the withdrawal of moisture from food products therein, said refrigerator including
(a) a cold insulated compartment
(b) a compressor, condenser and evaporator connected by refrigerant lines
(c) said evaporator being positioned within, and in the upper portion of, said cold insulated compartment, and having a surface temperature above 0° C.
(d) a continuously operating fan located within said cold insulated compartment above said evaporator for directing air vertically downwardly past the evaporator to prevent icing of the evaporator surface, resulting in the formation of condensation therein
(e) a drip dish in the lower portion of the compartment beneath the evaporator for receiving water produced by the condensation dropping from the evaporator
(f) said drip dish lying in the direct path of the air flow from the fan, whereby the air impinges upon the water contained in the drip dish to constantly absorb moisture therefrom and return it into the air surrounding the goods to be refrigerated
(g) an overflow drain which extends above the bottom of the dish to drain off excess water from the drip dish, and
(h) a vent opening in said compartment for exchanging air from within the compartment to the outside.

8. The refrigerator of claim 7, with the addition of
(a) a collecting trough exteriorly of said compartment and in communication with said overflow drain for collecting the excess water drained from said drip dish.

9. The refrigerator of claim 7, wherein
(a) said continuously operated fan is a radial flow fan.

10. The regrigerator of claim 7, wherein
(a) said evaporator is of the lamination type and includes evaporator coils, and
(b) laminations perpendicular to, and in contact with, said evaporator coils, whereby the air flowing over said laminations draws the cold away from the evaporator and into the interior of the compartment.

11. The refrigerator of claim 7, with the addition of
(a) a throttle element located in the refrigerant line between said compressor and evaporator.

12. The refrigerator of claim 11, wherein
(a) said throttle element is a capillary pipe.

13. The refrigerator of claim 7, wherein
(a) the surface of said evaporator is in excess of double the size of evaporators of refrigerators of comparable size.

* * * * *